United States Patent [19]

Peterman

[11] Patent Number: 4,693,418

[45] Date of Patent: Sep. 15, 1987

[54] MODULAR FLOOR

[75] Inventor: Robert J. Peterman, Hartland, Wis.

[73] Assignee: Spacesaver Corporation, Fort Atkinson, Wis.

[21] Appl. No.: 766,249

[22] Filed: Aug. 16, 1985

[51] Int. Cl.[4] ..... E01B 23/00

[52] U.S. Cl. ..... 238/10 R

[58] Field of Search ..... 104/249, 252, 259; 238/8, 10 R, 29, 59, 60, 61, 234; 312/198, 199, 201, 200

[56] References Cited

U.S. PATENT DOCUMENTS

| | | | |
|---|---|---|---|
| 811,130 | 1/1906 | Coverstone | 238/234 |
| 919,681 | 4/1909 | Berkley | 238/234 |
| 1,342,281 | 6/1920 | Foreman | 238/10 R |
| 1,578,093 | 3/1926 | Prillaman | 238/234 |
| 2,153,624 | 4/1939 | Jones | 238/29 X |
| 3,052,415 | 9/1962 | Ingold | 238/10 R |
| 3,923,354 | 12/1975 | Young | 312/201 |
| 4,123,126 | 10/1978 | Querengasser | 312/201 |
| 4,467,924 | 8/1984 | Morcheles | 312/198 X |

FOREIGN PATENT DOCUMENTS

| | | | |
|---|---|---|---|
| 781796 | 5/1935 | France | 238/10 R |

*Primary Examiner*—Robert B. Reeves
*Assistant Examiner*—Charles Barrett
*Attorney, Agent, or Firm*—Fuller, Puerner & Hohenfeldt

[57] ABSTRACT

A modular floor for manual storage systems consists of floor modules joined to create a longitudinal path of any desired length for supporting a wheeled carriage for movement therealong. Each floor module comprises a pair of parallel rails that are independently vertically adjustable by means of leveling screws in transverse rail supporting beams. The ends of the rails are notched and tongue and grooved to provide vertical and horizontal alignment of the ends of adjoining rails. The modular floor includes sturdy and neat ramps extending transversely on each side thereof. The invention further includes an anti-tip device composed of plates secured to the carriages and having lips that slide along and cooperate with a member fixed to the modular floor to prevent the carriages from tipping in the direction of longitudinal movement.

13 Claims, 6 Drawing Figures

MODULAR FLOOR

BACKGROUND OF THE INVENTION

1. Field of the Invention.

This invention pertains to mobile storage systems, and more particularly to apparatus for supporting a mobile storage system moveable carriage.

2. Description of the Prior Art.

It is known to use mobile storage systems in offices and libraries to conserve valuable floor space. Mobile storage systems usually include various combinations of stationary and longitudinally moveable storage units. The moveable storage units normally consist of a carriage mounted on wheels for rolling longitudinally along tracks or rails embedded in the building floor. Power for moving the carriage may be supplied either manually or through electric motors and associated circuits.

Although embedding the system rails in the floor is generally satisfactory, that construction does present some disadvantages. One disadvantage is the difficulty involved when releveling the rails after the initial installation. Releveling is required occasionally because even rails that are initially installed in a level attitude become non-level with time as the building floor shifts or sags. Another disadvantage of prior rail systems is that their installation in the floor is permanent. Consequently, if the office or library is to be remodeled and the mobile storage system relocated, it is a major task to rip the rails out of the floor and reinstall them at the new location. Since the movable carriages are typically quite high and long but relatively narrow in the direction of movement, they present a potential tipping problem. Various devices have been developed to reduce or eliminate the possibility of tipping, but the prior devices are usually quite complicated and costly to manufacture and install.

Thus, a need exists for a mobile storage system having an inexpensive and reliable anti-tip device and rails that are quickly and easily installed and maintained in the their original condition.

SUMMARY OF THE INVENTION

In accordance with the present invention, a mobile storage system is provided that includes a vertically adjustable modular floor for supporting the system movable carriages together with a simplified device for preventing carriage tipping in the direction of carriage motion. This is accomplished by apparatus that includes a series of longitudinally connectible floor modules comprised of a number of elongated frames for supporting the system rails and an anti-tip plate that hooks under an associated modular floor member.

The elongated frames are supported on the building floor by independently adjustable leveling screws. The frames are placed transversely under the rails, which are supported on the frames near the ends thereof and close to the leveling screws. To provide proper transverse spacing of the rails and also to maintain them in an upright attitude, the rails are joined to the opposite edges of flat horizontal panels. Several frames are fastened to a panel, thereby tying rails, panel, and frames together into a floor module. The modules are connectible longitudinally to create rails of desired length. The modules are preferably connected by means of simple clips joining the end frames of adjacent modules to each other.

The leveling screws are adjustable vertically independently of each other. Consequently, each rail may be adjusted vertically along a relatively short length thereof without effecting the level condition of the rest of the rail. To provide accurate horizontal alignment of abutting rails on adjacent modules, the rail ends are manufactured with cooperating tongue and grooves. Additionally, the rail ends are formed with cooperating notches and steps that aid in initial vertical alignment and that allow leveling of the abutting rail ends independently of each other. To enhance the appearance and safety of the modular floor of the present invention, attractive removeable ramps are included that slope downwardly and outwardly from each rail to the adjacent floor surface. The ramps are sufficiently strong and rigid to support a person standing on them next to the moveable carriage.

Further in accordance with the present invention, the mobile storage system includes a simple but effective device that prevents carriage tipping in the direction of longitudinal motion along the rails. The anti-tip device comprises one or more flat plates secured to the moveable carriage and having an outwardly turned lip. The lip slidingly hooks under the top leg of a sideways facing channel firmly fastened longitudinally to one end of the frame outboard of and parallel to one of the rails. Thus, if a carriage accidentally tends to tip, the lip of the anti-tip plate would contact and be restrained by the channel to thereby prevent tipping. To limit carriage movement along the modular floor, carriage stops are fastened at desired locations on the channel.

Other objects, aims, and advantages of the invention will be apparent to those skilled in the art from reading the disclosure.

DETAILED DESCRIPTION OF THE INVENTION

Although the disclosure hereof is detailed and exact to enable those skilled in the art to practice the invention, the physical embodiments herein disclosed merely exemplify the invention which may be embodied in other specific structure. The scope of the invention is defined in the claims appended hereto.

Figure 1:
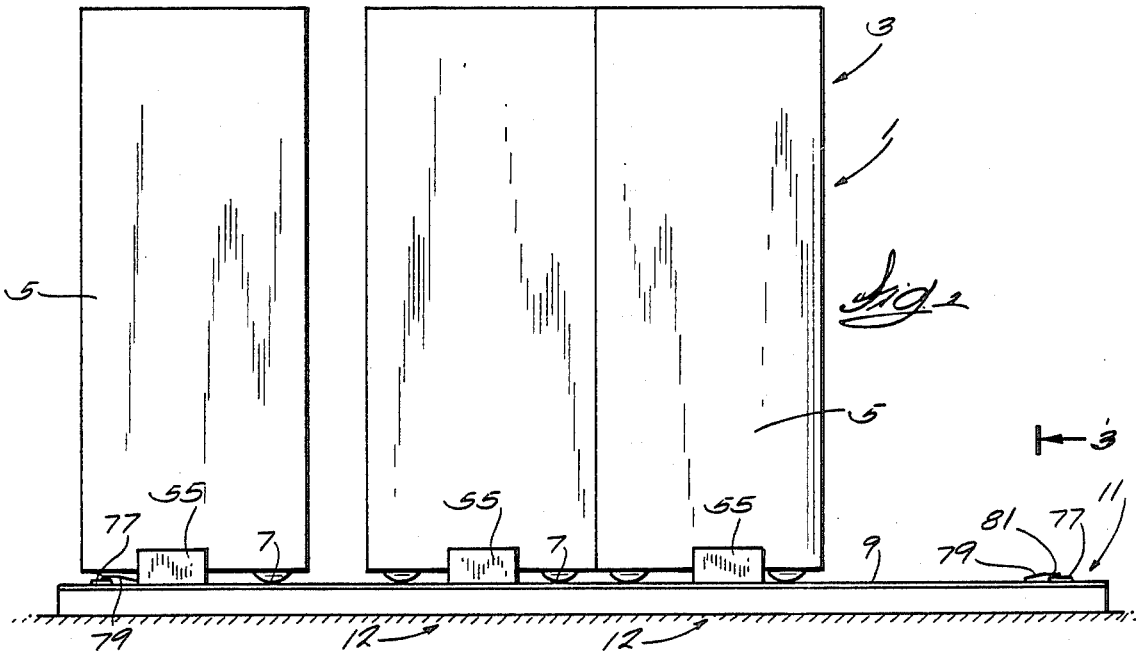
FIG. 1 is a side view of a mobile storage system that includes the modular floor of the present invention.

Referring to FIG. 1, a mobile storage system 1 is illustrated that includes the present invention. The mobile storage system is particularly useful for storing books and similar items in offices and libraries, but it will be understood that the invention is not limited to mobile storage applications.

The mobile storage system 1 includes one or more mobile storage units 3 that move horizontally along a fixed path. Each mobile storage unit 3 comprises a carriage assembly 5 supported by a plurality of wheels 7, as is known in the art. The mobile storage unit 3 may be rolled by means of conventional manual or power mechanisms.

Figure 2:
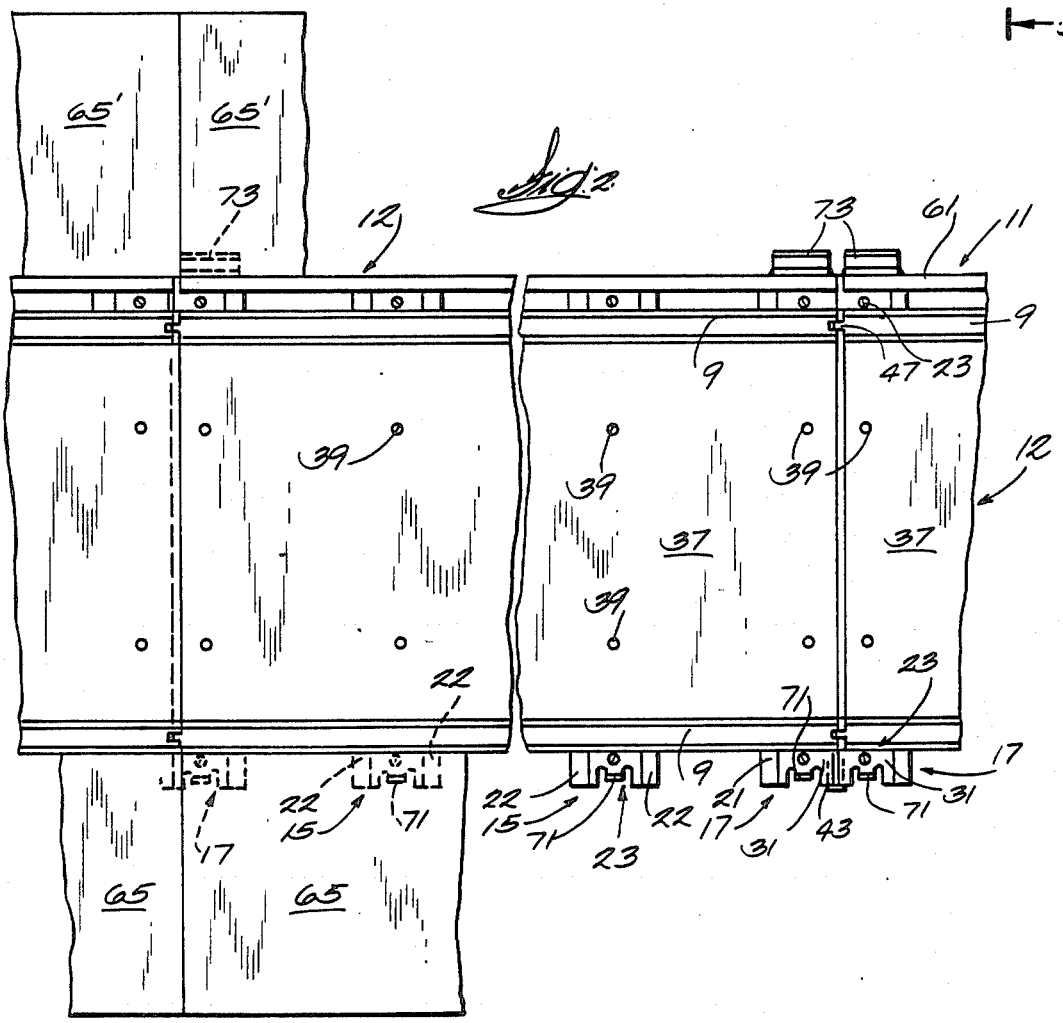
FIG. 2 is a partially broken top view of the modular floor of the present invention.
Figures 3, 4, 5, 6:
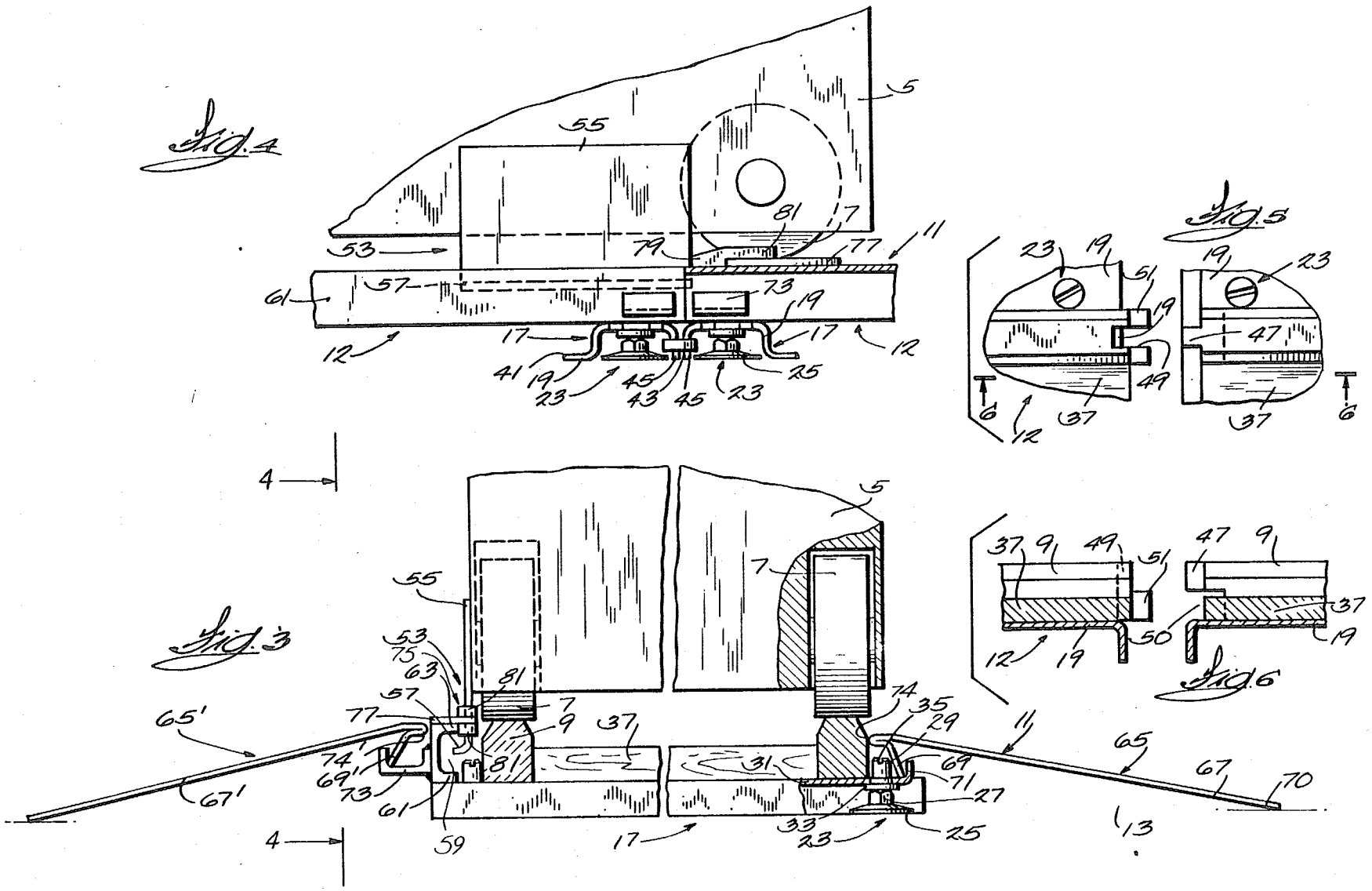
FIG. 3 is an enlarged end view, partially in section, taken along lines 3—3 of FIG. 1.
FIG. 4 is a partial sectional view taken along lines 4—4 of FIG. 3.
FIG. 5 is an enlarged exploded top view of the connection between adjacent floor modules.
FIG. 6 is a sectional view taken along lines 6—6 of FIG. 5.

In accordance with the present invention, the wheels 7 roll longitudinally along the rails 9 of a modular floor 11. As best illustrated in FIGS. 2 and 4, the modular floor 11 is composed of any desired number of modules 12. Each module 12 comprises a pair of parallel rails 9 supported above the building floor 13 by a number of interior frames 15 and end frames 17 placed transversely to the rails. Each frame 15 and 17 includes an elongated generally U-shaped beam 21 and 19, respectively. The interior beams are preferably manufactured with two outwardly extending flanges 22. The beams are supported at both ends on the floor 13 by leveling screws 23. As illustrated in FIGS. 3 and 4, the leveling screws 23 comprise a foot portion 25 of relatively large diameter that contacts the floor, a square shank 27, and a threaded end 29. To provide adequate support for the beams on the leveling screws, the center section of each beam, as, for example, center section 31 of end beams 17, is provided with reinforcing pads 33 welded thereto. The pads 33 and beams center section 31 define threaded openings for receiving the leveling screw threaded ends 29. Each leveling screw threaded end preferably is formed with a slot 35 in the end face thereof. Referring to FIGS. 2 and 3, the rails 9 are located adjacent the leveling screws 23 near the ends of the frames 15 and 17. It is preferred that the leveling screws be placed outboard of the rails. Vertical adjustment of a frame by means of a leveling screw directly affects the vertical position of the rail adjacent the leveling screw without affecting the entire rail, thus simplifying the rail leveling process. To maintain the rails in a parallel and upright attitude, they are secured by any suitable means to a structural wood panel 37. The rails 9 are wleded to cross frames 15 and 17. Cap screws 39 are used to attach the panel 37 to the frames 15 and 17, thus tying the beams, rails, leveling screws and panel into a module 12.

To enable the leveling screws 23 to be placed as closely as practical to the longitudinal ends of the modules 12, the end beams 19 are formed with only one outwardly extending flange 41, FIG. 4. To longitudinally join two modules, generally U-shaped spring clips 43 are placed over the unflanged legs 45 of adjacent end beams 17 at both ends thereof. Thus, a modular floor 11 of any length may be created for supporting the mobile storage units 3 by longitudinally joining the necessary number of modules.

After the modular floor 11 has been assembled and leveled, the wheels 7 of the mobile storage units 3 are placed on the rails. As best seen in FIG. 3, because the leveling screws 23 are outboard of the rails, the leveling screws are accessible with the mobile storage unit on the rails. Thus, the rails may be releveled at any time without removing the carriage from the modular floor or moving the carriage to a new location along the rails.

The present invention is also concerned with the accurate alignment of the rails 9 of adjoining floor modules 12. For that purpose, the ends of the rails are manufactured with cooperating notches and tongue and grooves. Referring to FIGS. 2, 5, and 6, it will be noticed that the left end of each rail terminates in a centrally located tongue 47. The tongue 47 is sized to closely fit within a centrally located groove 49 cut vertically in the right end of each rail. Thus, when modules are longitudinally joined, the rails of the adjacent modules are accurately aligned horizontally. To aid in aligning the rail ends to each other in the vertical direction, the left end of each rail is provided with an undercut notch 50 for receiving an associated step 51 in the right end of each rail. Accordingly, the rails of adjoining modules are quickly alignable vertically upon initial installation, and only final leveling by means of the leveling screws 23 is required.

Further in accordance with the present invention, the modular floor 11 in combination with the carriages 5, include a device 53 for preventing tipping of the carriages in the direction of movement. In the illustrated construction, the anti-tip device 53 comprises a plate 55 welded or otherwise firmly secured vertically to one end of each carriage. Two plates may be employed if the width of the carriage is relatively great. The lower end of the plate is bent outwardly to create a horizontal lip 57. The lip 57 slides within the recess 59 and adjacent to the top leg 63 of a channel 61 that is mounted longitudinally to the outer ends of the frames 15 and 17. The channel top legs 63 function to restrain the lip and thus prevent tipping of a moving and top heavy carriage if an object is placed on a rail in the carriage path.

It will be noticed that the channel 61 partially covers the leveling screws 23 on the side of the module 12 having the anti-tip device. To cover the leveling screws on the ends of the frames 15 and 17 on the side opposite the carriage anti-tip device, each floor module 12 includes a ramp 65. As best illustrated in FIG. 3, the ramp 65 is formed with a generally flat plate portion 67 terminating at one end in a bent over hook 69. End 70 of the plate portion 67 rests on the floor 13. The hook 69 is retained on the outer ends of the beams 19 and 21. For that purpose, the beams are fabricated with upturned tabs 71 at one end of the beam top sections 31. Thus, the ramps 65 safely cover the leveling screws, but they are easily removed from the tabs 71 to provide access to the leveling screws when it is desired to relevel the rails. Substantially identical ramps 65' are employed on the side of the modular floor having the anti-tip device 53. To retain the hooks 69' of the ramps 65', two or more short longitudinally spaced receptacles 73 are attached to the channel 61 of each module. To provide a neat appearance to the modular floor, the ramp hooked ends bent over portions 74 and 74' contact the outer edge of a rail 9 and the channel 61, respectively. Consequently, there are a minimum number of gaps in the module to collect dirt or give an unsightly appearance. In addition to the aesthetic properties of the ramps, they also are sturdily designed so as to permit a person to walk on them.

To limit the longitudinal movement of the mobile storage units along the rails 9, a simple but effective stop device 75 is fastened to desired locations on the modular floor 11. In the preferred embodiment, each stop device 75 comprises a plate 77 screwed or similarly fastened to the top leg 63 of the channel 61 so as to overhang the end of the top leg. See FIGS. 1, 3 and 4. A generally U-shaped carriage stop 79 is installed over the plate 77 in the path of the anti-tip plate 55. Preferably, the carriage stop 79 is retained by a gripping action created by spring legs 81 that are forced apart and slipped over the plate 77. In that manner, the travel limits in two directions of the carriages 5 may be easily set at any desired location on the modular floor, as, for example, near the ends of the modular floor as shown in FIG. 1, or at an intermediate location along the modular floor as shown in FIG. 4.

Without description, it is thought that the advantages to be gained from the disclosed embodiment of the invention will be apparent to those skilled in the art. Furthermore, it is contemplated that various modifications and changes may be made to the modular floor of the present invention within the scope of the appended claims without departing from the spirit of the invention.

I claim:

1. A floor module for supporting a wheeled carriage above a building floor comprising:

a. a pair of parallel rails adapted to support the carriage wheels for horizontal longitudinal movement therealong;

b. a plurality of longitudinally spaced beams placed transversely under and joined to the rails for supporting the rails, the opposed ends of the transverse beams being provided with upturned tab means outboard of the respective adjacent rails for defining longitudinal channels;

c. at least two vertically adjustable leveling screws received within each transverse beam near the ends thereof and outboard the rails for vertically adjusting the rails;

d. panel means and means for securing said panel means to the transverse beams to form a unitary module; and e. a ramp extending transversely from each side of the module, each ramp having a first end for being supported on the building floor and a second end defining hook means for being removably received within the transverse beam longitudinal channels defined by the beam upturned tab means, the ramps being of sufficient size and strength for a person to walk on them adjacent the wheeled carriage.

2. A floor module for supporting a wheeled carriage above a building floor comprising:

a. a pair of parallel rails adapted to support the carriage wheels for horizontal longitudinal movement therealong;

b. frame means for supporting the rails and connected to the rails, the frame means comprising a plurality of longitudinally spaced beams placed under the rails and transverse thereto;

c. leveling means for vertically adjusting the rails, the leveling means comprising at least two vertically adjustable leveling screws received within each beam near the ends thereof and in close proximity to the rails such that adjusting a leveling screw vertically adjusts the height of the rail proximate the leveling screw;

d. panel means and means for securing said panel means to said frame means to form a unitary module, the panel means comprising a generally flat panel superimposed upon and supported by the longitudinally spaced beams and having a first pair of parallel opposite edges, and wherein a rail is secured to each of the first pair of opposite edges; and e. fastening means for positively fastening the panel to each of the beams.

3. A modular floor for supporting a wheeled carriage above a building floor comprising:

a. a plurality of floor modules, each floor module comprising:

i. a pair of parallel rails adapted to support the carriage wheels;

ii. frame means for supporting the rails, means connecting the frame means to said rails, the frame means comprising a plurality of longitudinally spaced elongated beams placed transversely under the rails;

iii. leveling means for vertically adjusting the height of the rails above the building floor; and iv. panel means, means for connecting said panel means to said frame means, wherein the panel means comprises a substantially flat panel having a pair of parallel opposed edges having lengths substantially equal to the lengths of the rails, a rail being secured to each end of the opposed panel edges, and fastener means for fastening the flat panel to each of the beams; and b. clip means for longitudinally connecting adjacent modules, the clip means comprising at least one generally U-shaped spring clip adapted to engage a beam of each adjacent floor module to longitudinally join the modules together, so that the rails form a longitudinal path of desired length for carriage movement therealong.

4. The modular floor of claim 3 wherein:

a. the beams are fabricated as generally U-shaped channels having a pair of legs projecting downwardly with respect to the panel;

b. a beam is located proximate each longitudinal end of the panel; and c. the end beams of the longitudinally adjacent module are joined by at least one spring clip engaging a leg of each end beam channel.

5. The modular floor of claim 3 further comprising strong and rigid ramp means extending transversely from each floor module for safely supporting a person walking on the ramps adjacent the wheeled carriage and floor covering the leveling means and for providing a neat appearance to the modular floor.

6. The modular floor of claim 5 wherein the ramp means comprises a pair of ramps extending from each floor module in opposite transverse directions thereto, the ramps having longitudinal lengths generally equal to the lengths of the module rails, each ramp having a first end for contacting the building floor at a substantial distance from the floor module and a second end removably received in the module.

7. In combination with a movable storage unit having a carriage and a plurality of wheels, a modular floor for supporting the carriage above a building floor comprising:

a. a plurality of longitudinally joined floor modules, each floor module comprising:

i. first and second parallel rails adapted to support the carriage wheels for rolling movement therealong;

ii. frame means for supporting the rails above the building floor;

iii. leveling means adjustably received in the frames means for vertically adjusting the frame means; and iv. panel means, means for connecting said panel means to said frame means, to form a unitary floor module, the panel means comprising a substantially flat panel superimposed on and supported by the frame means and having first and second parallel edges and having a length generally equal to the lengths of the rails of the floor module, and wherein a rail is fastened to each of the first and second panel edges, and wherein the panels and rails are positively fastened to the frame means to thereby tie the frame means and rails together; and b. clip means for longitudinally connecting adjacent floor modules, so that a selected number of floor modules may be joined together to create a modular floor for carriage movement longitudinally therealong.

8. In combination with a movable storage unit having a carriage and a plurality of wheels, a modular floor for supporting the carriage above a building floor comprising:

a. a plurality of longitudinally joined floor modules, each floor module comprising:

i. first and second parallel rails adapted to support the carriage wheels for rolling movement therealong;

ii. frame means comprising a plurality of beams longitudinally spaced under and fastened to the rails and placed transversely thereto for supporting the rails above the building floor, wherein the beams are formed as generally U-shaped channels having a pair of legs extending vertically downwardly with respect to the panel means and rails, and wherein a beam is placed under each floor module near each longitudinal end thereof;

iii. a leveling screw adjustably received in each end of each transverse beam for vertical movement relative thereto, the leveling screws being located approximate the rails; and iv. panel means, means for connecting said panel means to said frame means to form a unitary floor module; and b. clip means for longitudinally connecting adjacent floor modules, the clip means comprising a generally U-shaped spring clip oriented to a horizontal plane and adapted to removably grip a vertical leg of each end beam of the adjoining modules, so that adjusting a leveling screw vertically adjusts the portion of the rail proximate the transverse beam.

9. The combination of claim 8 further comprising:

a. at least one anti-tip plate secured to an outside surface of an end of the carriage, the anti-tip plate being formed with a generally horizontal lip extending outwardly from the carriage; and b. channel means attached to the transverse beams outboard of the rails for cooperating with the anti-tip plate to prevent the carriage from tipping in the direction of longitudinal movement, the channel means comprising an elongated channel extending the length of the floor module and having a horizontally extending lower leg attached to the transverse beams and a horizontally extending upper leg located above the anti-tip horizontal lip to thereby restrain the anti-tip plate and prevent the carriage from tipping.

10. In combination with a moveable storage unit having a carriage and a plurality of wheels, a modular floor for supporting the carriage above a building floor comprising:

a. a plurality of longitudinally joined floor modules, each floor module comprising:

i. first and second parallel rails adapted to support the carriage wheels for rolling movement therealong;

ii. frame means for supporting the rails above the building floor;

iii. leveling means adjustably received in the frame means for vertically adjusting the frame means; and iv. panel means, means for connecting sai panel means to said frame means, to form a unitary floor module, wherein the ends of the rails of each floor module are formed with vertical tongue and grooves that cooperate for horizontal alignment of the rails of adjoining floor modules; and b. clip means for longitudinally connecting adjacent floor modules;

c. at least one anti-tip plate secured to an end of the carriage;

d. channel means attached to the frame means for cooperating with the anti-tip plate to prevent the carriage from tipping in the direction of longitudinal movement;

e. stop means fastened to the channel means for limiting the longitudinal movement of the carriage along the rails, wherein the stop means comprises:

i. a stop plate fastened to the channel means; and ii. a generally U-shaped clamp stop mounted over the stop plate and in the path of the anti-tip plate, so that carriage movement is prevented when the anti-tip plate contacts the clamp stop.

11. The combination of claim 10 further comprising first and second ramp means extending transversely from each floor module for providing a neat appearance and for safely supporting a person walking adjacent the carriage and for covering the leveling means proximate to at least one longitudinal rail.

12. The combination of claim 11 wherein each first ramp means comprises a ramp having a first end in contact with the building floor a substantial distance from the module and a second end removably received in the outboard ends of the transverse beams and adapted to abut the first rail above the leveling means and thereby safely cover the leveling means and provide a neat appearance to the modular floor and a safe support for the person.

13. The combination of claim 11 wherein each second ramp means comprises:

a. at least one receptacle attached to the channel means of each floor module; and b. a ramp having a first end in contact with the building floor and a second end removably received within the receptacle, the ramp second end being adapted to abut the channel means to provide a neat appearance to the modular floor.

* * * * *